US006629558B2

(12) United States Patent
Tsuji

(10) Patent No.: US 6,629,558 B2
(45) Date of Patent: Oct. 7, 2003

(54) DIE-CASTING MACHINE

(75) Inventor: Makoto Tsuji, Kanagawa (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 75 days.

(21) Appl. No.: 09/842,194

(22) Filed: Apr. 26, 2001

(65) Prior Publication Data

US 2001/0040019 A1 Nov. 15, 2001

(30) Foreign Application Priority Data

Apr. 26, 2000 (JP) ..... 2000/125518

(51) Int. Cl.[7] ..... B22D 17/08

(52) U.S. Cl. ..... 164/314; 164/155.3; 164/155.4; 164/155.5; 164/154.1

(58) Field of Search ..... 164/314, 457, 164/113, 155.3, 155.4, 155.5, 154.1

(56) References Cited

U.S. PATENT DOCUMENTS 5,988,260 A * 11/1999 Iwamoto ..... 164/457
6,241,003 B1 * 6/2001 Kodama et al. ..... 164/457

FOREIGN PATENT DOCUMENTS

JP 2000-141017 5/2000

* cited by examiner

*Primary Examiner*—Tom Dunn
*Assistant Examiner*—I. H. Lin
(74) *Attorney, Agent, or Firm*—Pillsbury Winthrop LLP

(57) ABSTRACT

A die-casting machine provided with a sleeve through which molding material is injected into a cavity formed by a pair of mold dies, an injection plunger slidably mounted in the sleeve, an injection cylinder having an injection piston connected through a piston rod with the injection plunger, and a boost cylinder formed with an inner diameter larger than that of the injection cylinder and mounted adjacent to the injection cylinder thereon in a side opposite to the piston rod, wherein the injection cylinder and boost cylinder are communicated with a conduit connected to each hydraulic chamber on a piston rod side of the cylinders and connected to a flow rate control valve arranged on a side of meter out with respect to the cylinders, thereby controlling a speed of the injection plunger in accordance with a flow rate of pressurized oil flowing in said valve, wherein the machine further provides a switching valve for supplying pressurized oil to the boost cylinder when reaction forces acting on the injection plunger during an injection operation exceeds a predetermined value and wherein the boost cylinder has a piston stroke at least equal to the injection plunger stroke corresponding to a volume of the cavity.

6 Claims, 6 Drawing Sheets

DIE-CASTING MACHINE

BACKGROUND OF THE INVENTION

The present invention relates to a die-casting machine used for producing a cast article with molding material injected into a cavity formed by a pair of mold dies, specifically to the machine provided with double stage cylinders capable of injecting the material such as semisolid or thixotropic state of metal and boosting it in the cavity.

Conventionally, a die-casting machine with double stage cylinders, as shown in FIG. 5, is known, which is used for producing a cast article with molding material injected into a cavity formed by a pair of mold dies. This type of die-casting machine 90 is provided with a sleeve 14 through which a molding material 13 is injected into a cavity 12 formed by a pair of mold dies 11 and an injection plunger 15 slidably mounted in the sleeve 14, which pushes forward the molding material 13 supplied through an opening 16 into the sleeve 14.

The die-casting machine 9 is also provided with an injection cylinder 17 in which a piston 19 coupled through a piston rod 18 with the injection plunger 15 is slidably mounted and a boost cylinder 17A adjoining to the cylinder 17, in which a piston 20 for pressing the molding material 13 in the cavity 2 is slidably mounted.

To produce a cast article using the die-casting machine 90, the following two stage operations are necessary. The first stage is to supply pressurized oil to an oil chamber 19A on the head side of the injection cylinder 17 and to inject the molding material 13 into the cavity 12 by advancing the injection plunger 15 fixedly connected to the piston 19 of the injection cylinder 17. In the case, the molding material 13 is at first pushed forward in the sleeve 14 at low speed VL, as shown in FIG. 6, and then injected into the cavity 12 at high speed VH to avoid falling of temperature, immediately after the molding material 13 pushed out of the sleeve 14 reaches a gate 21.

After the molding material 13 is filled in the cavity 12 by advancing the injection plunger 15 at a position corresponding to completion of filling, the second stage starts. The second stage is to supply pressurized oil to the oil chamber 20A on the head side of the boost cylinder 17A so as to advance the piston 20 of the boost cylinder 17A, thereby holding to press and cool the molding material 13 filled in the cavity 12 until it becomes solid state.

As described above, the conventional type of die-casting machine 90 employs the two stage operations to produce the cast article. In case that the material to be cast in the cavity is fully liquid state like the molten metal, the conventional die-casting machine could produce any desired cast articles. However, in case that the material to be cast is semisolid or thixotropic state, the following problems arise. Firstly, in case of the semisolid or thixotropic state, because of a large flow resistance occurring when such semisolid or thixotropic state of metal to be cast passes through a narrow space like the gate 21, it is difficult to advance the injection plunger 15 at a desired speed, as the result, it takes much more time than expected to fill such material into the cavity 12. Therefore, the conventional die-casting machine 90 could not produce normal cast articles in case of semisolid or thixotropic state of metal to be cast. Secondly, to avoid such a problem, it may be proposed that the injection cylinder with large diameter for generating much more injection powers is employed. In the case, however, still another problem comes up, that is, the pressurized oil amount larger than that of the conventional machine is necessary for injection operation. For instance, even on the stroke operation at low injection speed VL in which only a small injection pressure needs, much more amount of oil has to be supplied by the quantity corresponding to the diameter enlargement of injection cylinder. Further, relating to the enlargement, characteristics of the injection cylinder on speed rising up, speed sloping, and boosting become worse, as the result, it becomes difficult to produce the cast article with high quality. Also, relating to the enlargement, total cost of the machine becomes expensive because of large sizing of the injection cylinder, the injection plunger and various hydraulic valves.

SUMMARY OF THE INVENTION

The object of the present invention is to provide a die-casting machine with double stage cylinders, which allows to operates a boost cylinder whenever it is required to keep enough injection power to be supplied, in accordance with increasing of flow resistance arising from a gate shape or formation and physical condition of molding material to be cast when the molding material reaches near the gate, especially capable of producing cast products with high quality even in case of semisolid or thixotropic state of metal as a material to be cast in a cavity.

More specifically, the present invention is arranged as follows:

A die-casting machine according to the present invention is provided with a sleeve through which cast material is injected into a cavity formed by a pair of mold dies, an injection plunger slidably mounted in the sleeve, an injection cylinder having an injection piston connected through a piston rod with the injection plunger, and a boost cylinder formed with an inner diameter larger than that of the injection cylinder and mounted adjacent to the injection cylinder thereon in a side opposite to the piston rod, wherein the injection cylinder and boost cylinder are communicated with a conduit connected to each hydraulic chamber on a rod side of the cylinders and connected to a flow rate control valve arranged on a side of meter-out with respect to the cylinders, thereby controlling a speed of the injection plunger in accordance with a flow rate of pressurized oil flowing in the valve.

In the die-casting machine of the present invention, there is further provided with a switching valve for controlling supplies of pressurized oil to a hydraulic chamber on a side of the piston in the boost cylinder. According to the above arrangement of the present invention, the switching valve is arranged so as to operate when the injection plunger reaches a predetermined stroke position during an injection operation.

According to still another arrangement of the present invention, a pilot operated servo valve may be employed as the switching valve.

In the above die-casting machine of the present inventions the boost cylinder is arranged to have a piston stroke equal to the injection plunger stroke corresponding to a volume of the cavity In the above die-casting machine of the present invention, there is further provided with pressure sensors for detecting pressures in each oil chamber on both sides of a piston rod and a piston head in the injection cylinder, thereby judging whether the reaction force against the injection plunger exceeds a predetermined value, based on a difference in pressures detected by said pressure sensors, respectively.

BRIEF DESCRIPTION OF THE DRAWINGS

The above and other objects, features, and advantages of the present invention will be made more apparent from the description of preferred embodiments with reference to the accompanying drawings wherein.

DETAILED DESCRIPTION OF PREFERRED EMBODIMENTS

Figure 1:
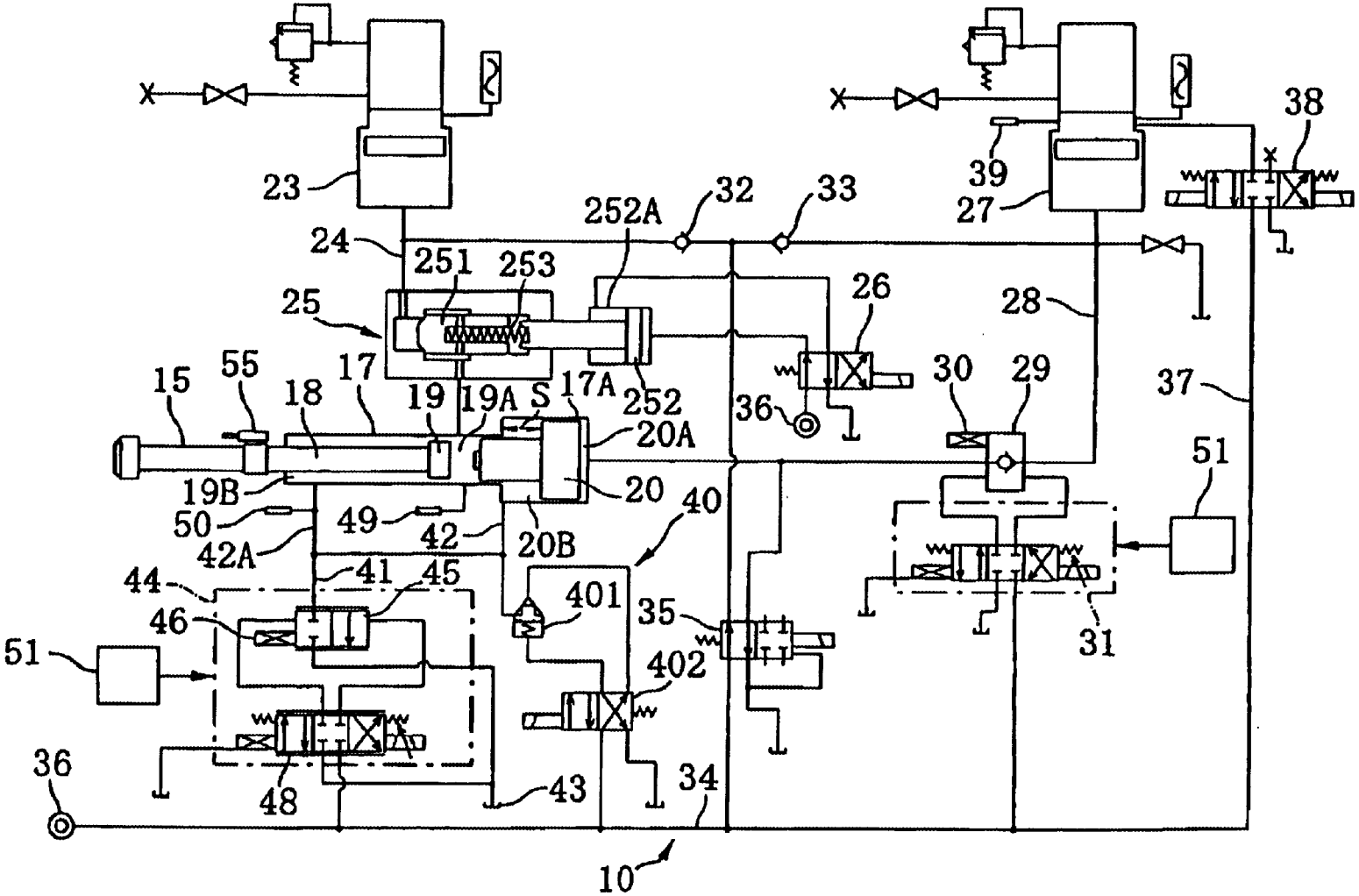
FIG. 1 is a schematic diagram showing hydraulic circuit arrangement in an embodiment of the present invention.

An embodiment of the present invention will be described below with reference to attached drawings of FIG. 1 to FIG. 4. It should be noted that portions or elements corresponding to the reference numerals in FIG. 5 are designated by the same reference numerals in the drawings of FIGS. 1 to 4, and their detailed explanations are omitted.

FIG. 1 illustrates a hydraulic circuit arrangement for operating an injection cylinder 17 and a boost cylinder 17A in a die-casting machine as the embodiment of the present invention, both of the cylinders constituting a double stage cylinder of the present invention.

In FIG. 1 the injection cylinder 17 has a piston 19 for injecting a molding material, which is fixedly coupled through a piston rod 18 with an injection plunger 15. On the head side of the piston 19, that is, on the head side of the injection cylinder 17, there is provided an oil chamber 19A to which a volume of predetermined pressure oil is supplied through a pressure oil conduit 24 and a pilot check valve 25 from an accumulator 23.

The pilot check valve 25 has a valve body 251 and a piston 252 coupled through a spring 253 with the body 251. When a volume of pilot operated pressure oil is applied through a switching valve 26 to a room 252A on the rod side of the piston 252, the valve body 251 moves to the right (opening-direction) and allow the conduit 24 to communicate with the oil chamber 19A. The pilot check valve 25 also has the spring 253 forcing the valve body 251 to the left (closing-direction). Therefore, in case of no difference in oil pressure between the conduit 24 and the oil chamber 19A or oil pressure in the chamber 19A being larger than that in the conduit 24, the valve body 251 moves to closing-direction, thereby preventing a back flow of the oil chamber 19A to the conduit 24 when the boost cylinder 17A operates.

In FIG. 1, there is provided with the boost cylinder 17A adjacent to the injection cylinder, on which a piston 20 is mounted slidably for boosting the molding material into the cavity 12. On the head side of the piston 20, that is, on the head side of the boost cylinder 17A, there is provided an oil chamber 20A to which a volume of predetermined pressure oil is supplied through a pressure oil conduit 28 and a control valve 29 from an accumulator 27.

Figure 2:
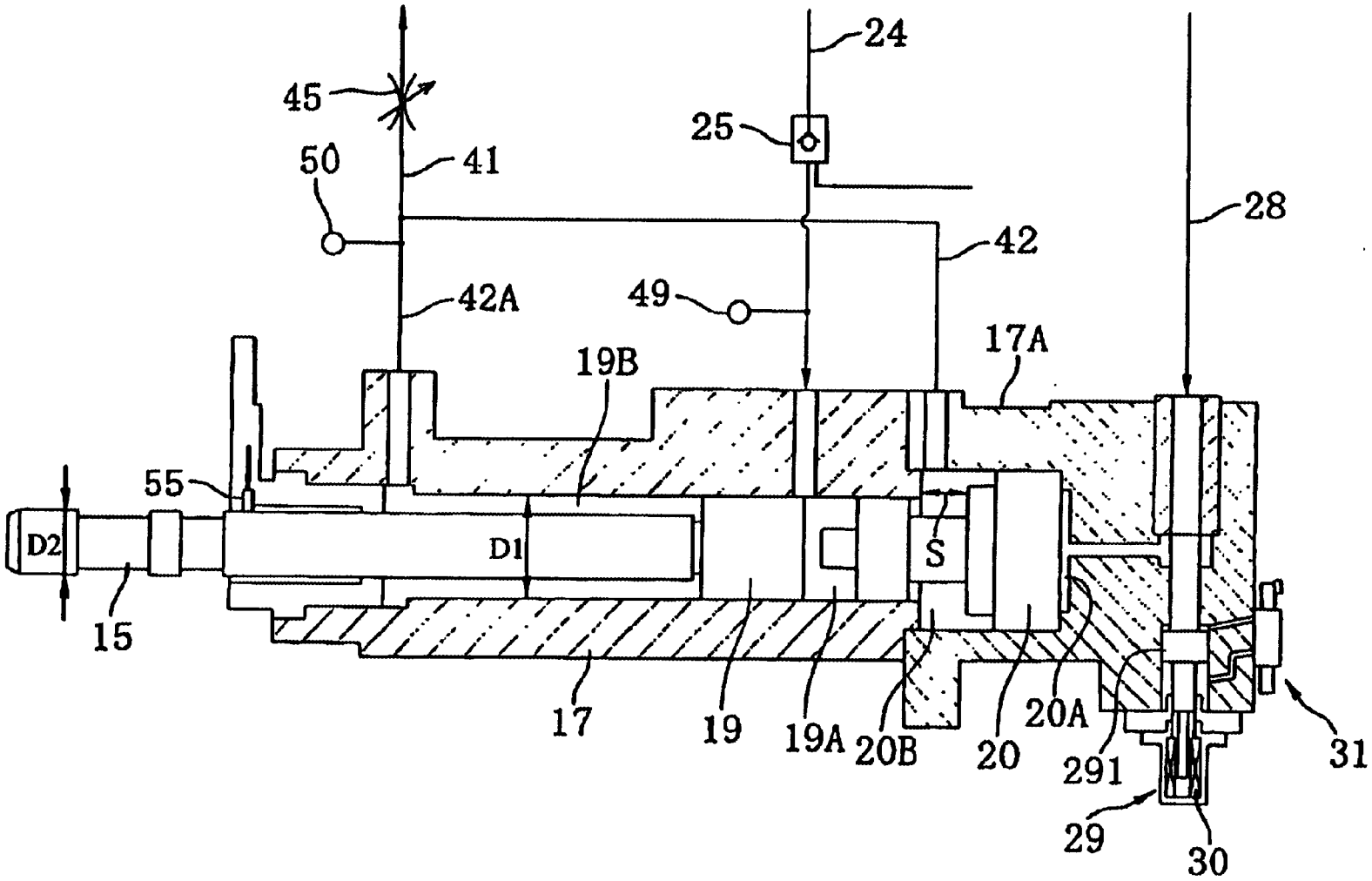
FIG. 2 is a detailed sectional view taken along the axis of the injection cylinder of the aforesaid embodiment.

The control valve 29 has a position detector 30 for detecting a position, that is, degrees of opening of a main spool 291, as shown in FIG. 2, the output of the detector 30 is given as a feedback signal to a pilot servo valve 31 through a control device 51.

The pressure oil conduits 24 and 28 are communicated respectively through check valves 32 and 33 and a switching valve 35 with a pressure oil conduit 34 to which a volume of pressure oil supplied from a pressure oil source 36. Therefore, when the switching valve 35 is switched as indicated in the drawing, a desired volume of pressure oil is supplied from the oil source 36 to the accumulator 23 and 27.

The pressure oil conduit 34 is further communicated through a branch channel 37 and a boost pressure control valve 38 with the back port of the accumulator 27 in which a pressure sensor 39 is provided for detecting a pressure of oil supplied therein. The pressure oil conduit 34 also is communicated through a hydraulic returning circuit 40 and a discharging conduit 42A with an oil chamber 19B on the rod side of the injection cylinder 17, and through the hydraulic returning circuit 40 and a discharging conduit 42 with an oil chamber 20B on the rod side of the boost cylinder 17A.

The hydraulic returning circuit 40 is provided with a logic valve 401 and switching valve 402. When the switching valve 402 is switched as indicated in the drawing so as to open the logic valve 401, a volume of pressure oil flows through the discharging conduit 42A and discharging conduit 42 into the oil chambers 19B and 20B, respectively, thereby allowing the pistons 19 and 20 to return in the right direction of the drawing.

A hydraulic discharging channel 41 is communicated through a hydraulic flow rate control circuit 44 with an oil tank 43. The hydraulic flow rate control circuit 44 is provided with a flow rate control valve 45 for controlling a flow rate of oil from the discharging channel 41 to the tank 43, a position detector 46 for detecting a position of the spool, that is, degrees of opening of the valve 45, a servo amplifier 47 (see FIG. 3) for amplifying the signal from the detector 46, and a pilot servo valve 48 for controlling the degrees of opening of the flow rate control valve 45 based on the output of the servo amplifier 47.

In the FIG. 1, the discharging conduit 42 communicating with the oil chamber 20B on the rod side of the boost cylinder 17A and the discharging conduit 42A communicating with the oil chamber 19B on the rod side of the injection cylinder 17 are communicated with each other. Therefore, the oil pressure in the both chambers is always held to be identical.

The flow rate control valve 45 locates at a meter-out side with respect to the injection cylinder 17 and the boost cylinder 17A, and is communicated with the hydraulic discharging channel 41. Therefore, a movement or position of the injection plunger 15 is controlled by an instruction signal to the flow rate control valve 45. The pilot servo valve 31 as shown in FIG. 1 and FIG. 2 is illustrated as a preferable valve in case that a sharp response to the instruction from the control device 51 is required for operating the boost cylinder 17A. Instead of the pilot servo valve 31, an electric switching valve of the type with two directional positions may be used from the view point of the scope of the present invention. Such a switching valve merely switches the supplies of pressure oil from the accumulator 27 to a head side oil chamber 20A of the boost cylinder 17A.

In the FIG. 1, the stroke length S of the boost cylinder 17A is formed longer than that of the conventional machine. The reason is as follows:

As described above in FIG. 5, in case of the semisolid or thixotropic state of metal to be cast, a large flow resistance occurs even before completion of filling process when such semisolid or thixotropic state of metal passes through a narrow space like the gate 21. So, in this embodiment of the present invention, the injection plunger 15 is forced to keep advancing under the injection operation by operating the piston 20 of the boost cylinder 17A as soon as such a large flow resistance occurs, and the piston 20 moves to the left until the completion of filling process. In such a condition, it is necessary for the stroke S of the piston 20 at least a length equal to the plunger stroke corresponding to the volume of the cavity.

The control device 51 controls each valve shown in the drawing in accordance with a predetermined operation program, and controls each process of injecting, filling and boosting to be executed. The control device 51 may be constituted by means of the existing computer system or programmable sequence controller.

Figure 3:
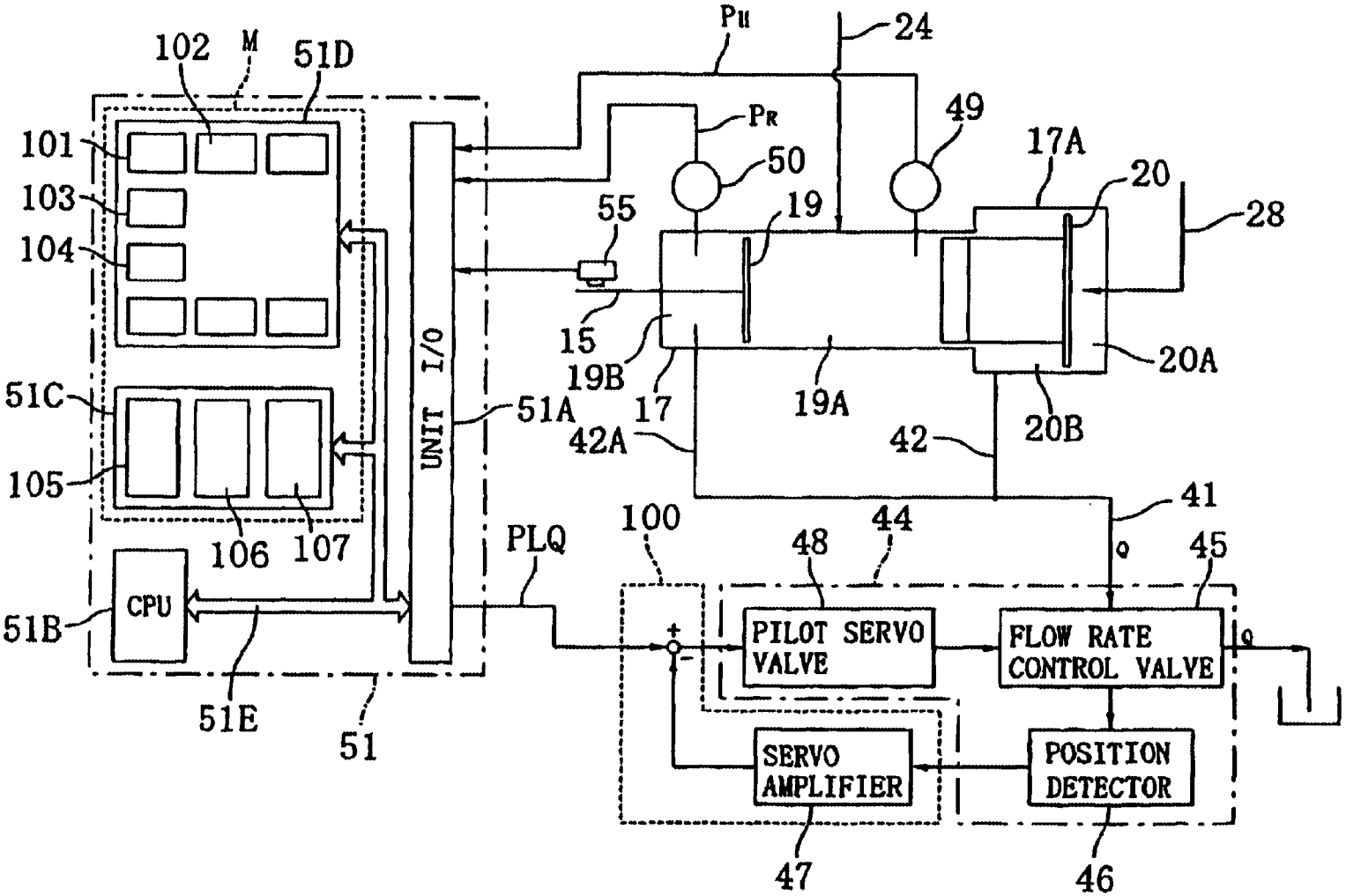
FIG. 3 is a block diagram of the controller in FIG. 1.

FIG. 3 illustrates the inner structure of the injection cylinder 17 and the boost cylinder 17A shown in FIG. 2 with simplified form, and also illustrates a block diagram showing the relationship between each cylinder 17, 17A, the control device 51 and the hydraulic flow rate control circuit 44 for explaining chiefly the advancing operation of the cylinders.

In the FIG. 3, a volume of pressure oil is supplied through the conduits 24 and 28 to the oil chambers 19A, 20A on the head sides of the pistons 19, 20 of the injection cylinder 17 and boost cylinder 17A, respectively. On the other hand, the oil chambers 19B and 20B on the rod sides of the cylinders 17 and 17A are communicated with each other through the outer discharging conduits 42A, 42 which merge into the discharging channel 41 connected to the flow rate control valve 45.

Numerals 49 and 50 designate pressure sensors to detect oil pressures in the chambers 19A and 19B, which convert the detected pressures to electric signals. The signals are sent through I/O unit 51A into the control device 51. Similarly, numeral 55 designates a position detector to detect a position of the injection plunger 15. The position detector 55 converts the detected position of the plunger 15 into an electric signal sent to the control device 51 through I/O unit 51A. A servo unit 100 enclosed by the dotted line functionally designates as a servo amplifier 47 in the I/O unit 51A, corresponding to servo amplifier module, digital-analogue converter, analogue-digital converter and etc, though these also not shown in the I/O unit 51A. In the hydraulic flow rate control circuit 44 and the servo unit 100, the spool position corresponding to a flow rate Q flowing through the flow rate control valve 45 is detected by the position detector 46 and the detected signal is amplified by the servo amplifier 47, and then, an instruction signal PLQ given from the control device 51 for the plunger speed required at the instance and the output of the servo amplifier 47 are compared, and the difference signal is applied to the pilot servo valve 48.

The control device 51 shown at the left side area in the FIG. 3 is largely classified to the I/O unit 51A, central processing unit(CPU) 51B, program memory unit 51C, data memory unit 51D (both forming a memory M) and bus line 51E connecting those units. In the data memory unit 51D, a register 101 represents the actual position of the injection plunger 15, and a register 102 represents the actual spool position of the flow rate control valve 45, which is given as the output signal of the position detector 46 in the hydraulic flow rate control circuit 44. Similarly, registers 103 and 104 represent pressures in the oil chambers 19A and 19B respectively, which are given from the pressure sensors 49 and 50.

In the program memory 51C, a memory 105 stores a series of instruction program on the operation for the piston 19 of the injection cylinder 17. Similarly, a memory 106 stores a series of instruction program on the operation for the piston 20 of the boost cylinder 17A. A memory 107 stores a series of supervising program for watching output signals from the pressure sensors 49 and 50, and a series of instruction program for generating signals to instruct so as to supply a volume of pressure oil from the accumulator 27 to the boost cylinder 17A in case that the difference in oil pressures detected by the sensors 49 and 50 exceeds a predetermined value.

Hereinafter, the process of injecting, filling and boosting operations during one shot cycle by the die-casting machine provided with the configuration described above will be explained.

As shown in FIG. 5, prior to the process of injecting the molding material 13 is supplied through the opening 16 into the sleeve 14. Then, the control device 51 generates an instruction signal to the switching valve 26 so as to switch to different position from shown on the drawing in FIG. 1. As the result, the pilot operated check valve 25 is opened by the pilot pressure acting on the rod side chamber 252A of the piston 252 and allows the pressure oil from the accumulator 23 to flow into the oil chamber 19A on the head side of the injection cylinder 17, thereby injecting process starting, that is, the injection plunger 15, fixedly coupled with the piston 19 of the injection cylinder 17, starting its advancing operation. Accordingly, the molding material 13 in the sleeve 14 is pushed forward, and then injected into the cavity 12 as the plunger 15 advances forward.

The control device 51 generates an instruction signal at first so that the flow rate control valve 45 is throttled so as to move the plunger 15 at low speed. Then, when it(the control device 51) has judged based on the position signal from the position detector 55 that the molding material 13 injected from the sleeve 14 has reached near the gate 21, it further generates an instruction signal so that the flow rate control valve 45 is controlled through the pilot servo valve 48 based on a difference $\Delta P$ (=PR−PH) between the pressure PR detected by the sensor 49 and the pressure PH detected by the sensor 50, and it further generates an instruction signal so that the control valve 29 is opened through the pilot servo valve 31, thereby supplying pressure oil from the accumulator 27 to the oil chamber 20A on the head side of the boost cylinder 17A. Assuming that the ratio of the sectional area of the piston 19 and piston 20 is expressed as 1/2, and further, 100 $Kg/cm^2$ is a back pressure which corresponds to a reaction force to the plunger 15 in accordance with flow resistance caused by a flow of molding material through the gate 21 into the cavity 12 during the injection operation, the back pressure of the piston 20 becomes a half, that is, 50 $Kg/cm^2$. For instance, in order to produce the difference in pressure of 80 $Kg/cm^2$ at the piston 19 of the injection cylinder 17 for filling the molding material into the cavity 12 while accelerating the plunger 15, the difference in pressure of only 40 $Kg/cm^2$ is necessary at the piston 20 of the boost cylinder 17A. Therefore, in case that the oil pressure of 150 $Kg/cm^2$ is supplied from each accumulator 23, 27, it is impossible to accelerate the plunger 15, because 180 $Kg/cm^2$ at the oil chamber 19A on the piston head is required under the above condition. On the contrary, it is possible to do so, because only 90 $Kg/cm^2$ at the oil chamber 20A on the piston head is required. This advantage derives from the ratio 1/2 of the sectional area between the piston 19 and 20. Accordingly, in case of semisolid metal as the molding material, it is difficult to inject the molding material at high speed by using only the piston 19 of the injection cylinder 17. However, it is possible to do so by using the piston 20 of the boost cylinder 17A.

Figure 4:
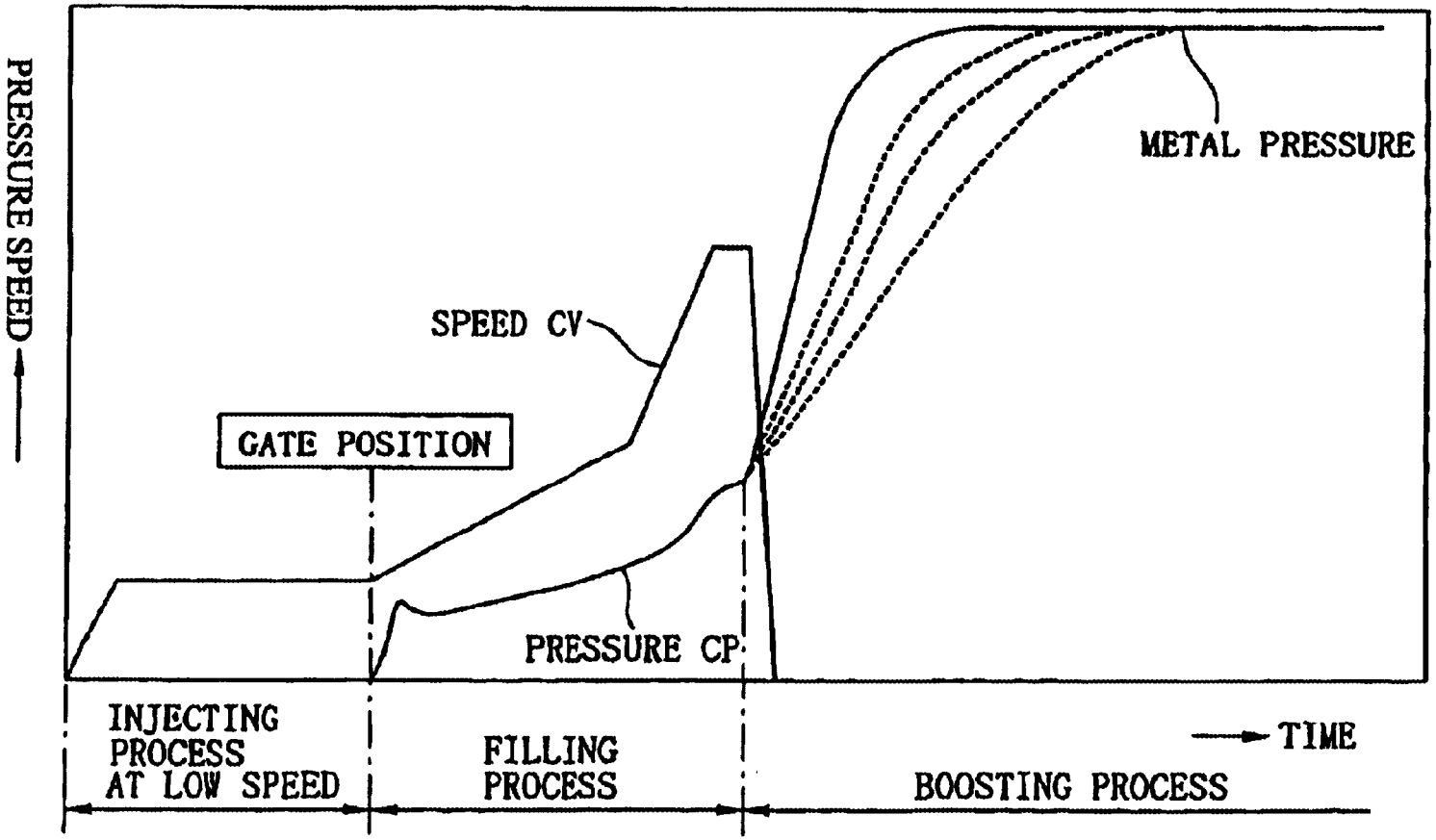
FIG. 4 is a graph showing the change of injection speed and reaction force acting on the injection plunger in case of semisolid metal as a cast material in FIG. 1.
Figure 5:
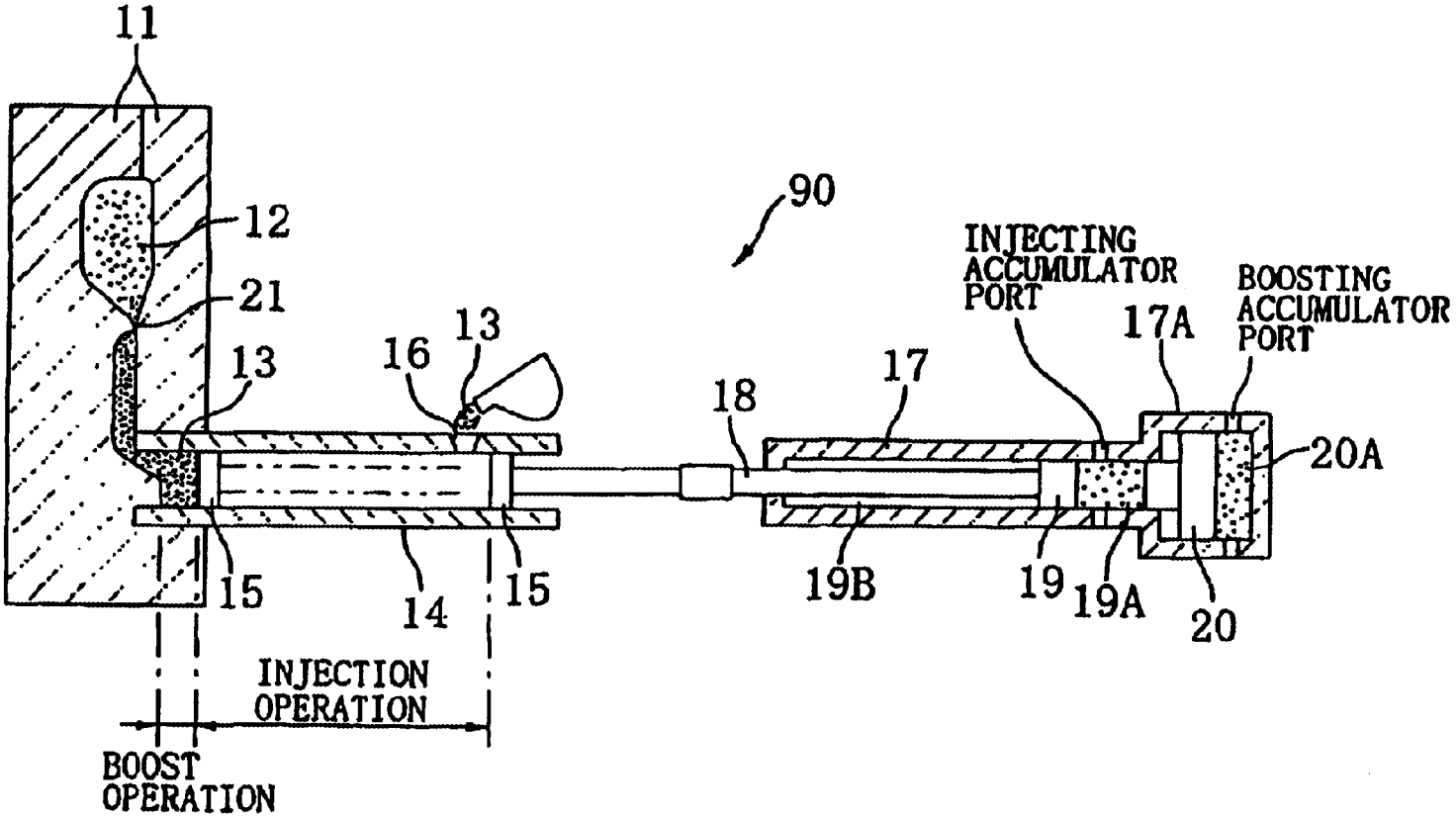
FIG. 5 (PRIOR ART)
FIG. 5 is a sectional view taken along the axis of the injection cylinder of a conventional die-casting machine with double stage cylinders.
Figure 6:
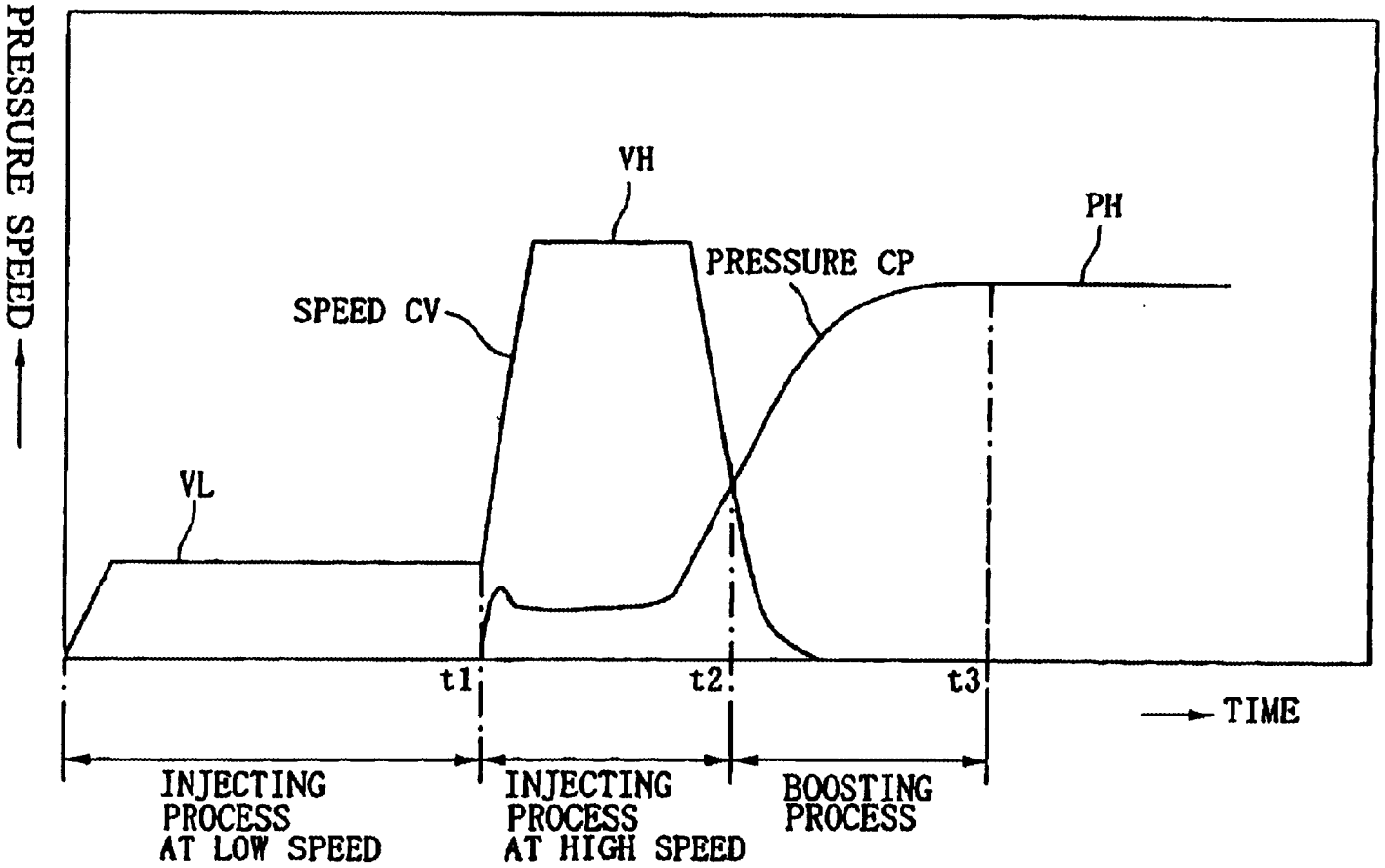
FIG. 6 (PRIOR ART)
FIG. 6 is a graph showing changing of injection speeds and reaction forces acting on the injection plunger during one shot cycle of the conventional die-casting machine with double stage cylinders.

In the case, when the molding material reaches the gate while injection operation at low speed VL, the reaction force against and acting on the injection plunger 15 suddenly increases as shown in FIG. 4. To resist this sudden rising up of the reaction force against the plunger 15, the piston 20 is activated in advance. As shown in FIG. 2, under the condition that the piston 20 is activated and the plunger 15 advances at a speed corresponding to a signal to the hydraulic flow rate control circuit 44 from the control device 51, which allows to flow the pressure oil through the conduit 28 into the boost cylinder 17A, when a sudden increase of the reaction force occurs, the speed of the plunger 15 will decrease, and as the result, the volume of pressure oil in the discharging conduits 42, 42A and the oil chambers 19B, 20B, those being communicated with each other, is instantaneously stopped to flow into the flow rate control valve 45. This means that a difference in pressure between the tank and the discharging channel 41 instantaneously becomes zero. In turn, the difference in pressure between the oil chambers 20A and 20B increases, and the plunger 15 can advance by the boost cylinder 17A producing a force larger than a reaction force by the flow resistance suddenly increased during the injection operation.

In other words, since the conduits 42 and 42A is communicated through the discharging channel 41 with the flow rate control valve 45 located on the meter out side with respect to the cylinders 17 and 17A, the difference in pressure between the oil chamber 20A on the head side and the oil chamber 20B on the rod side of the boost cylinder 17A instantaneously increases and prevents the speed of the plunger 15 from decreasing or becoming zero, even in case of occurring of the reaction force acting on the plunger 15 caused by a sudden increase of the flow resistance during injection operation.

In the above arrangement, the oil chamber 19B on the rod side of the injection cylinder 17 and the oil chamber 19A on the rod side of the boost cylinder 17A are communicated with each other so as to be equal in pressure, thereby enabling the plunger 15 to advance smoothly and preventing occurrences of a vibration of the plunger 15 and surge pressures in the conduits 42 and 42A during injection operation.

Accordingly, in the above described embodiment, the molding material can be smoothly injected and filled into the cavity, even in case that the flow resistance arising from the gate formation and physical states of the molding material increases suddenly, particularly in case of semisolid or thixotropic state of metal as the molding material. As the result, a cast article with high quality can be produced.

Also, in the above embodiment, because the flow resistance, that is, reaction force acting on the plunger 15 is measured as the difference $\Delta P$ in pressure between the pressures PR and PH detected by the sensor 49 and 50 respectively, the reaction force and its change are detected correctly, thereby enabling precise definition of a timing to operate the boost cylinder 17A.

According to the die-casting machine of the present invention, there is advantages that 1) the injection plunger can advance with a desired speed as instructed by the flow rate control valve, even in case that the flow resistance suddenly increases while the boost cylinder operates, and therefore, 2) the die-casting machine can produce cast products with high quality even if the molding material is a semisolid or thixotropic state of metal and 3) that the die-casting machine can prevent occurring of the vibration of the injection plunger and surge pressure during the injection operation, because the flow rate control valve is arranged on the meter-out side of both the injection cylinder and boost cylinder, and further the each oil chamber on the rod side of both the cylinders are communicated through a conduit with each other, and connected to the flow rate control valve.

In addition of the above advantages, there arc further advantages that a new die-casting machine can be constituted, which is applicable particularly to the molding material such as semisolid or thixotropic state of metal, with low cost and by means of mechanically changing a conventional boost cylinder so as to have its piston stroke only a little longer.

It should be understood, of course, that the foregoing disclosure relates only to preferred embodiments of the invention, and that it is intended to cover all changes and modifications of the example of the invention herein chosen for the purpose of the disclosure which does not constitute departures from the spirit and scope of the invention set forth in the appended claims.

What is claimed is:

1. A die-casting machine comprising a sleeve through which molding material is injected into a cavity formed by a pair of mold dies, an injection plunger slidably mounted in said sleeve, an injection cylinder having an injection piston connected through a piston rod with said injection plunger, and a boost cylinder having a boost piston, said boost cylinder formed wits an inner diameter larger than an inner diameter of said injection cylinder and mounted adjacent to said injection cylinder thereon in a side opposite to said piston rod, wherein:

said injection piston slidably engages an inner surface of said injection cylinder to thereby define a rod-side injection hydraulic chamber within said injection cylinder on a side of said injection piston adjacent to said piston rod, and a piston-side injection hydraulic chamber within said injection cylinder on a side of said injection piston opposite to said piston rod;

said boost piston slidably engages an inner surface of said boost cylinder to thereby define an injection-side boost hydraulic chamber within said boost cylinder on a side of said boost piston adjacent to said injection cylinder, and a piston-side boost hydraulic chamber within said boost cylinder on a side of said boost piston opposite to said injection cylinder;

said injection cylinder and boost cylinder are in fluid communication with a conduit connected to said rod-side injection hydraulic chamber and said injection-side boost hydraulic chamber and connected to a flow rate control valve arranged on a meter out side with respect to said cylinders, thereby controlling a speed of said injection plunger in accordance with a flow rate of pressurized oil flowing in said valve; and wherein said boost cylinder has a piston stroke at least equal to a plunger stroke corresponding to a volume of said cavity.

2. A die-casting machine according to claim 1, wherein said machine is further provided with a switching valve for controlling supplies of pressurized oil to said piston-side boost hydraulic chamber in said boost cylinder.

3. A die-casting machine according to claim 2, wherein said switching valve operates when a reaction force against said injection plunger caused by flow resistance of molding material near a cavity gate reaches a predetermined value during an injection operation.

4. A die-casting machine according to claim 2, wherein said switching valve operates when said injection plunger reaches a predetermined stroke position during an injection operation.

5. A die-casting machine according to claim 2, wherein said switching valve is a pilot operated servo valve.

6. A die-casting machine according to claim 2, wherein said machines further provided with pressure sensors for detecting pressures in the rod-side injection hydraulic chamber and the piston-side injection hydraulic chamber on both sides of the injection piston in said injection cylinder, thereby judging whether a reaction force against said injection plunger exceeds a predetermined value, based on a difference in pressures detected by said pressure sensors, respectively.

* * * * *